United States Patent [19]

Heck et al.

[11] 4,202,395

[45] May 13, 1980

[54] ADJUSTABLE SHADE CONSTRUCTION

[75] Inventors: Richard A. Heck, West Bloomfield; David J. Dekker, Birmingham, all of Mich.

[73] Assignee: Sundberg-Ferar, Inc., Southfield, Mich.

[21] Appl. No.: 941,547

[22] Filed: Sep. 11, 1978

[51] Int. Cl.[2] ..... E06B 3/94

[52] U.S. Cl. ..... 160/84 R; 160/279

[58] Field of Search ..... 160/84 R, 167, 279, 160/348

[56] References Cited

U.S. PATENT DOCUMENTS

| | | | |
|---|---|---|---|
| 355,046 | 12/1886 | Auld | 160/167 |
| 577,244 | 2/1897 | Forsyth | 160/279 |
| 593,929 | 11/1897 | Emery | 160/279 |
| 3,055,419 | 9/1962 | Rubin et al. | 160/348 |
| 3,192,991 | 7/1965 | Anderle | 160/167 |
| 3,279,528 | 10/1966 | Gambon et al. | 160/279 |
| 3,465,806 | 9/1969 | Sulkes | 160/167 |
| 3,528,477 | 9/1970 | Abraham | 160/84 R |

*Primary Examiner*—Peter M. Caun

*Attorney, Agent, or Firm*—Benjamin W. Colman

[57] ABSTRACT

An adjustable shade structure embodying an expandable compactible shade member secured to upper and lower shade bars slidable engaged in a parallelogram cord system. The shade structure is supported upon a suitable frame, such as a window or door frame or upon a free standing floor supported frame.

20 Claims, 12 Drawing Figures

ADJUSTABLE SHADE CONSTRUCTION

BACKGROUND OF THE INVENTON

The invention relates to a shade or screen structure for a window, door or other similar opening, the shade structure being adjustable in height and in its posture with respect to the opening. The shade can be positioned in upper or lower areas of the opening, or anywhere in between. The shade is provided with a compactible and expandable shade member to cover the opening in part or to any desired extent. The shade member can be made of a flexible paper, fabric, plastic or composition sheet or strip material, to fold upon itself in a uniform or loosely oriented arrangement, or in corrugations or panels to expand and compact in a relatively uniform manner.

In this prior art, shades are disclosed having shade members that compact and expand vertically. These shade members are secured to and between shade bars which ride in vertical lateral channels affixed to window frames or are freely movable on the frames. In one instance, the shade bars have rollers at their ends which are spring loaded to bear frictionally against the channel webs and thus remain adjustably positioned. In other shade structures the upper and lower shade bars are directly connected to cord members that draw the shade bars together to compact the shade member therebetween or separate the shade bars to expand the shade member. The shade bars are independently positionable by manipulation of the cords which are engaged by a fastener on the frame when the shade member has been adjusted to the desired posture.

SUMMARY OF THE INVENTION

The adjustable shade structure of this invention involves and relates to an expandable and compactible shade member secured to and between upper and lower shade bars slidable freely on a frame or between frame-affixed spaced apart substantially parallel guide members, such as channels, for adjustably positioning the shade member. The lateral ends of the shade bars are provided with rollers, or equivalent means, engaged by a parallelogram cord system secured to the frame or guide members. The shade bars are manually movable independently of each other upon the cord system to expand or compact the shade member therebetween.

The adjustable shade construction of this invention has several advantages. The shade member can be positioned anywhere within the compass of the frame or frame-affixed guide members. It can be compacted to a minimum height and positioned at the top or bottom of the guide members or anywhere in between. It can be expanded partially or fully, to shade or cover selected areas of a window or door frame opening or to fully cover the opening.

Although reference will frequently be made to a window and window frame, it will be understood that the shade or screen structure of this invention can also be secured to a free standing frame and function as a screen, a room divider, or other similar device.

These and various further and more specific features, objects and advantages of the invention will appear from the description given below, taken in connection with the accompanying drawings, illustrating by way of example preferred embodiments of the invention. Reference is here made to the drawings annexed hereto and forming an integral part of this specification.

DESCRIPTION OF PREFERRED EMBODIMENTS

Figure 1:
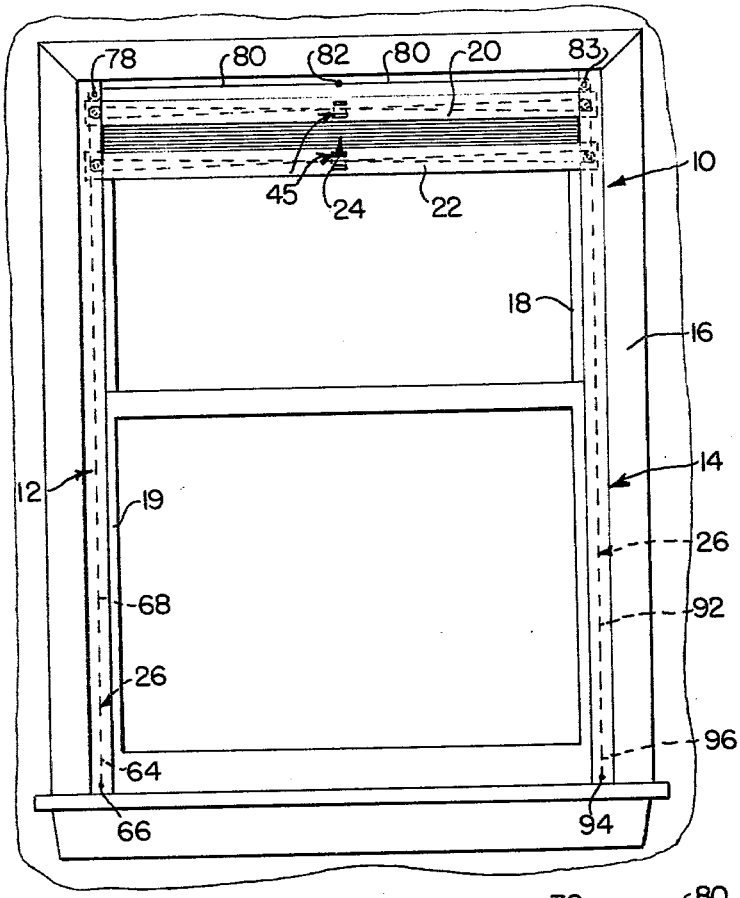
FIG. 1 is a vertical elevational view of a window and window frame in a wall area, illustrating a preferred embodiment of the invention. In this view, the shade member is shown in compacted form.
Figure 3:
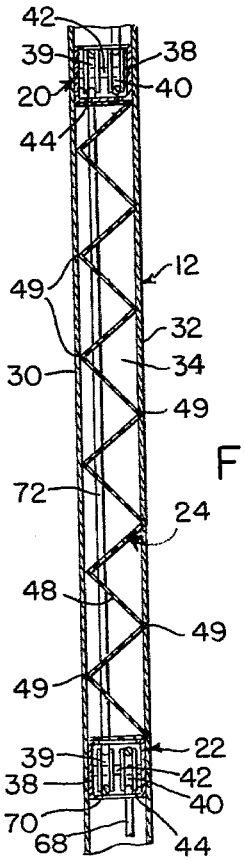
FIG. 3 is a vertical sectional view taken substantially on the line 3—3 of FIG. 2.
Figure 2:
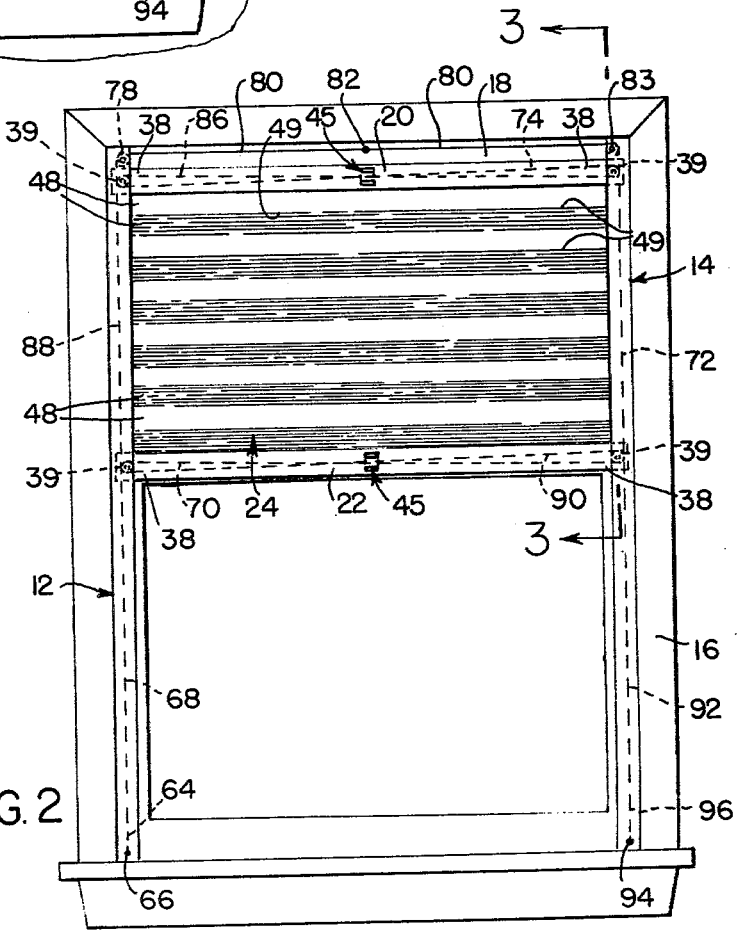
FIG. 2 is a view similar to FIG. 1, showing the shade member in a partially expanded state in the upper portion of the window opening.
Figure 4:
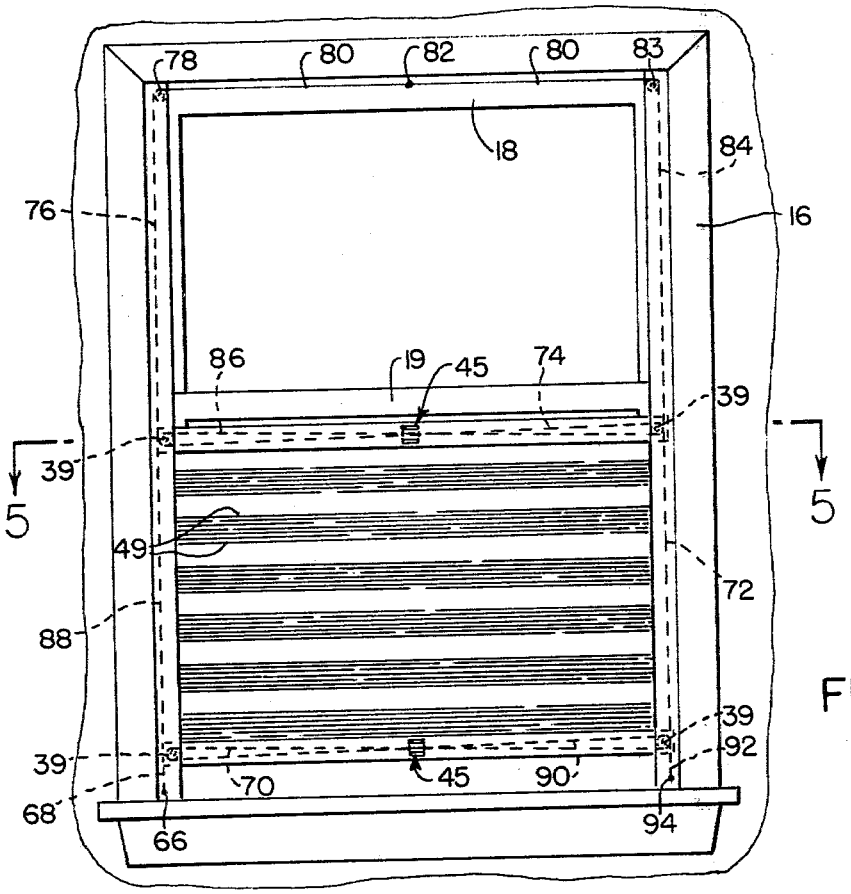
FIG. 4 is a view similar to FIG. 1, showing the shade member in a partially expanded state in the lower portion of the window opening.
Figure 5:
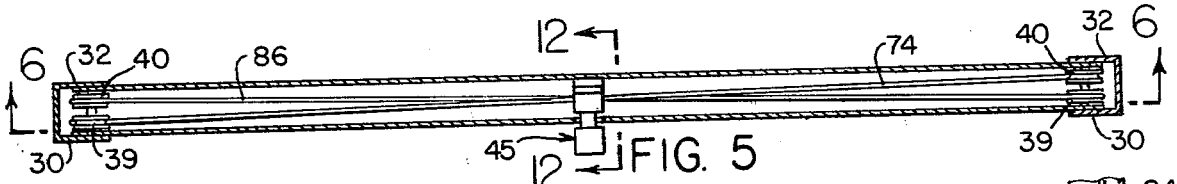
FIG. 5 is a horizontal transverse sectional view taken substantially on the line 5—5 of FIG. 4, showing the shade bar rollers and cord arrangement.
Figure 6:
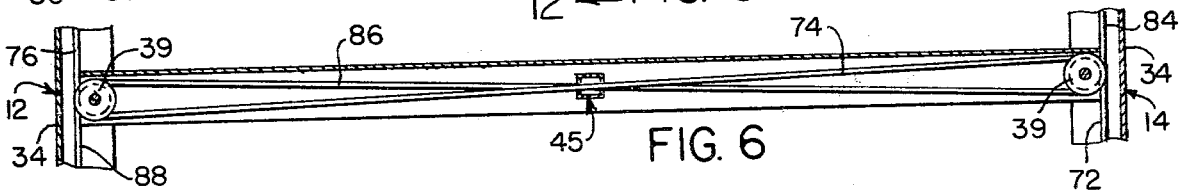
FIG. 6 is a horizontal elevational view taken substantially on the line 6—6 of FIG. 5.
Figure 7:
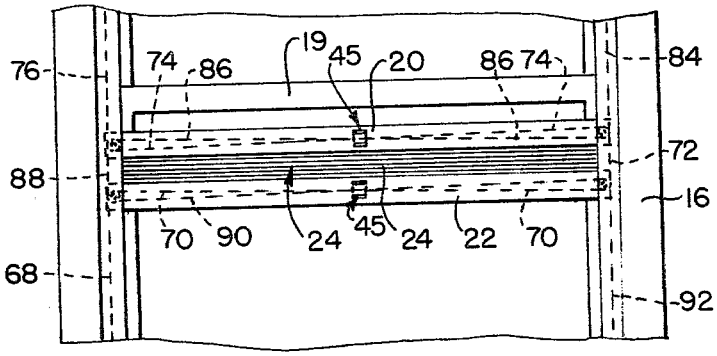
FIG. 7 is a fragmentary elevational view, similar to FIG. 4, showing the shade bars and shade member in compacted posture in the lower portion of the window opening.

As shown in several views of the drawings, the shade structure 10 comprises a pair of upper and lower shade bars 20, 22 respectively, a compactible, vertically expandable shade member 24, and a parallelogram cord system 26 engageable by the shade bars. The shade structure 10 is guided by a pair of spaced apart vertically disposed channel members 12, 14 secured to a window frame 16 adjacent the window sash members 18, 19.

The channel members 12, 14 each comprises parallel spaced apart legs 30, 32 and an intermediate web portion 34. The legs 32 are secured to the window frame 16 with the web portions 34 facing each other in opposing relationship. The channels function as guide members for the shade bars 20, 22 and the shade member 24. Alternatively, angle members, suitably secured to the frame structure 16, can also be used as guide members.

Shade bars 20, 22 are manually movable upon the cord system 26 and when used with guide members 12, 14 extend from a point adjacent and inwardly of the web portion 34 of channel 12 to the web portion of the opposite facing channel 14. Each end 38 of each shade bar is provided with a pair of grooved rollers 39, 40 rotatably arranged in adjacent vertical planes on horizontal pins 42 affixed to the bar ends 38 in slots 44. Attached substantially medially to each of the shade bars is a manually operable clip or fastener member 45 having a pair of spring loaded jaws or elements engaging portions of the cord system 26, to secure the shade bars from sliding and/or twisting askew on the cord system.

The shade member 24, FIGS. 1–7, secured to the shade bars at its upper and lower ends, comprises a sheet of relatively opaque paper, plastic or other suitable material formed into transverse panels 48 connected together along their longitudinal edges 49 in a zig-zag arrangement, so that the panels compactly fall upon each other or expand as shown in FIGS. 2, 3, 4 and 5.

Figure 8:
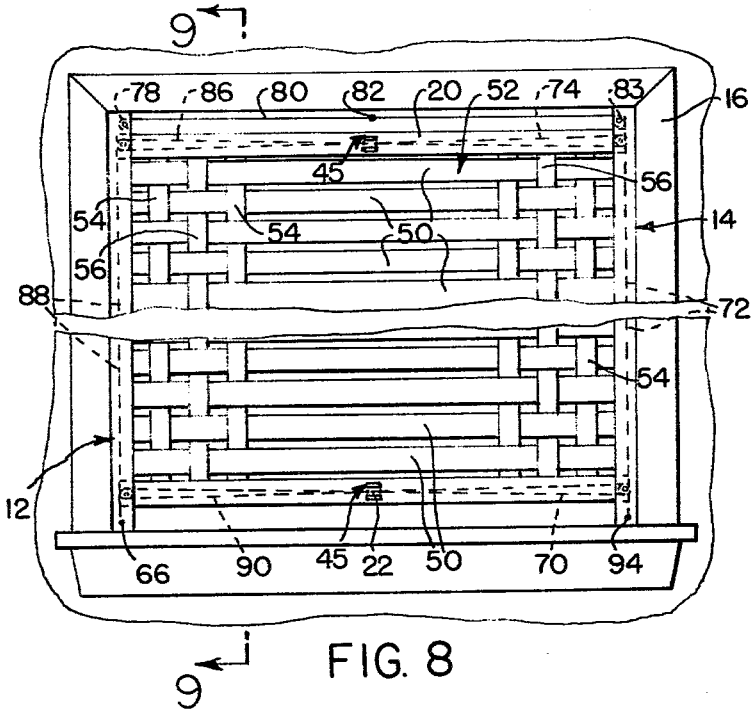
FIGS. 8 and 10 are front elevational views, similar to FIG. 7, showing modified forms of the shade member.
Figure 9:
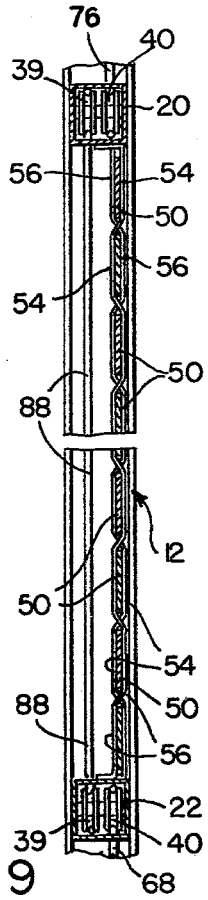
FIGS. 9 and 11 are vertical sectional views taken substantially on the lines 9—9 and 11—11 of FIGS. 8 and 10 respectively.
Figure 12:
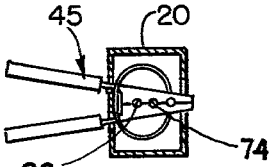
FIG. 12 is a transverse vertical sectional view taken substantially on the line 12—12 of FIG. 5.
Figure 11:
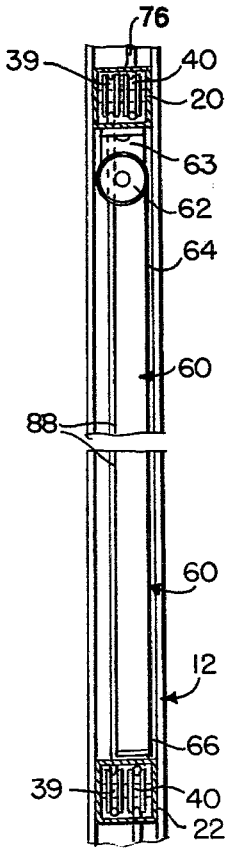
Figure 10:
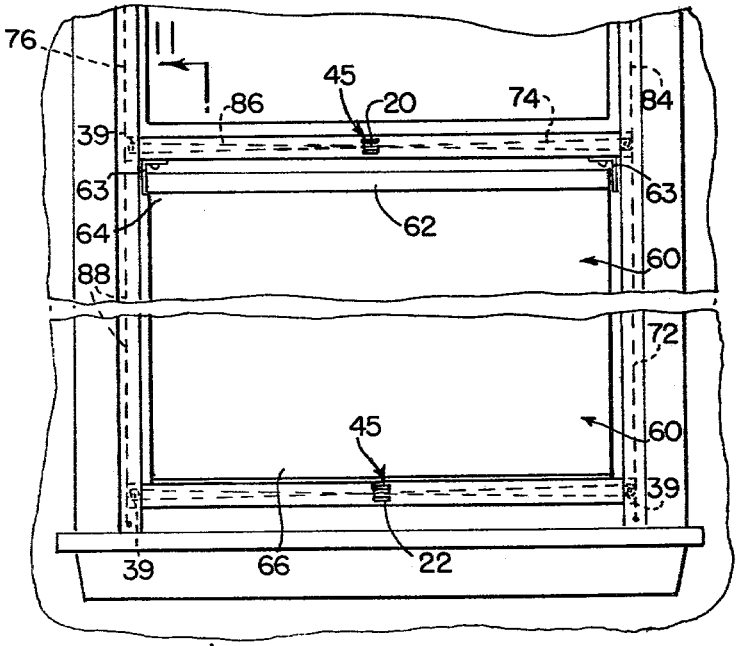

There are of course a number of other forms of shade member that can be used, including but not limited to the individual discrete panel strips 50 (FIGS. 8, 9) and the roll-up shade member 60 (FIGS. 10, 11).

The shade member 52 comprises the panel strips 50 arranged in a series between the staggered vertical ribbons or tapes 54, 56 secured at their upper and lower ends to the shade bars 20, 22 respectively. As in the case of shade member 24, wherein the panels 48 compact in a zig-zag attitude, the panel strips 50, which may or may not be attached to the ribbons 54, 56, in compacting, generally will tend to fall and rest upon each other in a zig-zag attitude.

The roll-up shade member 60, in sheet or film form, is secured at its upper proximal end 64 to the roller 62 which is rotatably mounted by bracket members 63, 63 secured to and mounted upon the upper shade bar 20. The shade member is drawn downwardly by the lower shade bar 22 when moved away from the upper shade bar, or upwardly when drawn in that direction by the upper shade bar. The roller 62 is of conventional spring loaded roller shade construction except that the pawl and cam are absent, allowing the spring applied tension to hold the shade member 60 in a relatively taut attitude during movement of the shade bars 20, 22 in either direction, up or down. The tautness of the cord system 26 holds the shade bars in the positions to which they have been moved, against the force of the spring in the roller 62.

The width of the shade member panel 48, the panel strips 50 or the shade member 60, as the case may be, may optionally be less than the distance between the web portions 34 of the guide members 12, 14, if such members are used. The guide members will more easily control the compacting and expanding of the shade members, but such guide members are not absolutely essential because other means can perform the same function. For example, the cord portions of the cord system 26, or the frame construction, can be used to control the compaction and expansion of the shade members. In some instances, depending upon the nature and character of the shade member, guide means may not be necessary.

The shade member may also be made of a screen-type material suitable for a window or door opening, or for an area or room divider in which the guide members, if required, are mounted on a self-supporting floor mounted frame.

The parallelogram cord system 26, preferably a single unitary length of cord, comprises a proximal end portion 64 fixedly secured to a pin or fastener 66 attached to or adjacent the lower end of the guide members 12, a first cord portion 68 extending upwardly therefrom within channel 12 to, over and about an upper quadrant of grooved roller 40 at the left end 38 of shade bar 22, a second cord portion 70 extending longitudinally along the shade bar 22 to, over and about a lower quadrant of grooved roller 39 at the right end 38 of the shade bar. The cord system continues with the third cord portion 72 extending within the confines of channel 14 upwardly to, over and about an upper quadrant of grooved roller 40 at the right end 38 of the upper shade bar 20, a fourth cord portion 74 extending therefrom longitudinally along the shade bar 20 to, over and about a lower quadrant of the grooved roller 39 at the left end of the upper shade bar. From there, the cord system continues with a fifth cord portion 76 to a pin or pivot 78 affixed to the upper end of channel member 12 or on the frame 16, a sixth cord portion 80 extending therefrom to a pin or fastener 82 affixed to the frame 16 intermediate the channel guide members where the cord is tied and fixed. Tying the cord at this point or to the pivot 78 or the pivot 83 secures the cord system substantially against movement as the shade bars 20, 22 are rolled thereon. Such tying of the cord also assists in maintaining the cord system taut against the rollers of the shade bars.

The cord system 26 then proceedds downwardly from pivot 83 in channel 14 with a seventh cord portion 84 to, over and under a lower quadrant of roller 39 at the right end 38 of the upper shade bar 20, an eighth cord portion 86 extending longitudinally along the shade bar and crossing fourth cord portion 74 to, over and about an upper quadrant of the grooved roller 40 at the left end 38 of the upper shade bar. The ninth cord portion 88 extends downwardly therefrom within channel 12 to, over and under a lower quadrant of roller 39 at the left end 38 of the lower shade bar 22, tenth cord portion 90 extending along the lower shade bar and crossing second cord portion 70 to, over and about an upper quadrant of grooved roller 40 at the right end 38 of the lower shade bar 22. Finally, the eleventh cord portion 92 extends downwardly in channel 14 to a fixed pin 94 or other suitable fastener at the lower end of the channel where the distal end cord portion 96 is tied and fixed. It is desirable to maintain the cord system 26 in a relatively taut condition throughout. Optionally, a coiled spring (not shown) may be inserted in and secured to the cord portion 80 to assist in rendering the system taut.

It will thus be seen that the cord system 26 engages the shade bars 20, 22 with cord portions engagable by the grooved rollers 39, 40 at each end of the bars. As these bars are each independently movable manually, the two rollers at each end rotate in opposite directions as they engage respective cord portions. The rollers 39, 40 are securely engaged by the cord portions that extend both upwardly as well as downwardly from them, holding the shade bars is parallel, yet allowing each to have free movement toward or away from the other.

As the shade bars are moved toward or away from each other in the cord system, the intermediate shade member 24, 52 or 60 is compacted or extended respectively. Compacting the shade member may be uniformly effected as by alternate zig-zag layering of the connected panels 48 or 50 upon themselves, or may be at random as with a flexible fabric or sheet material that folds more or less regularly upon itself, depending on whether lateral guide members are used.

As will be seen in the several views of the drawings, the shade structure 10 can be arranged in several postures because each shade bar 20, 22 is independently movable in the cord system. The shade member, in each instance, can be fully expanded or compacted, or extended only partially with respect to the height of the area defined by the guide members or the supporting frame, as the case may be.

The channel members 12, 14 are preferably made of a metallic or plastic material; the shade bars 20, 22 preferably of metal, plastic, wood or a suitable composition material, their rollers 39, 40 preferably of metal or plastic; the shade member 24 or 52 preferably of a suitable plastic, paper, fabric or equivalent sheet, strip or film material suitable for folding or compacting, the shade member 60 preferably of fabric, plastic or equivalent material suitable for rolling onto a roller bar. Screen material is preferably of the plastic type, although some metallic materials may be suitable.

It will of course be understood by persons skilled in the art to which the invention pertains that the shade or screen structure hereindisclosed may be applied to a door as well as to a window opening, or may be arranged in a free standing posture on a frame as an area or room divider. Also, the shade structure, though illustrated and described in vertical disposition, can be arranged in a horizontal attitude.

Although certain particular embodiments of the invention have been disclosed herein for purposes of explanation, further modifications or variations thereof, after study of this specification, will or may become apparent to persons skilled in the art to which the invention pertains. Reference should be had to the appended claims in determining the scope of the invention.

We claim:

1. In an adjustable shade or screen construction mountable upon a supporting structure, the combination comprising a pair of spaced apart, independently manually adjustably movable shade bars, a pair of rollers rotatably disposed in each end of said shade bars, in planes parallel to the direction of movement of said shade bars, a shade or screen member secured to and disposed intermediate said shade bars.

said shade or screen member being relatively flexible, compactable and expandible between said shade bars, a parallelogram cord system secured to said supporting structure and engaging said shade bars about selected portions of said rollers, and means mounted on said shade bars releasably engageable with portions of said cord system to adjustably secure said shade bars on said cord system, whereby said shade bars are movable independently and adjustably toward and away from each other upon said cord system.

2. The construction defined in claim 1, wherein said combination further includes a pair of guide members disposed in substantially parallel, spaced apart, opposedly facing relationship upon said supporting structure, said shade bars being slidably movable in and transversely between said guide members, said parallelogram cord system being secured alternatively to said supporting structure or said guide members.

3. The construction defined in claim 1, wherein said guide members comprise channel members having legs of one said guide member substantially in parallel with the respective legs of the other said guide member.

4. The construction defined in claim 1, wherein said supporting structure comprises a wall mounted frame defining a wall opening.

5. The construction defined in claim 1, wherein said supporting structure comprises a free standing frame defining an area therewithin.

6. The construction defined in claims 4 or 5, wherein said guide members are vertically mounted on lateral elements of said frame or supporting structure.

7. The construction defined in claims 4 or 5, wherein said guide members are horizontally mounted on upper and lower elements of said supporting structure or frame.

8. The construction defined in claim 2, wherein said guide members comprise angle members disposed in opposedly facing relationship and secured to said supporting structure.

9. The construction defined in claim 6, wherein said shade bars comprise upper and lower members independently movable in said guide members.

10. The construction defined in claim 1, wherein said rollers are annularly grooved on their outer peripheries and independently rotatable.

11. The construction defined in claim 1, wherein said shade or screen member comprises a sheet or layer of fabric, plastic or similar film material.

12. The construction defined in claim 1, wherein said shade or screen member comprises a plurality of panel sections integrally formed and connected together along their longitudinal edges.

13. The construction defined in claim 1 or 2, wherein said shade or screen material comprises a plurality of panel sections hingedly connected together along their longitudinal edges.

14. The construction defined in claim 1, wherein said shade or screen member comprises a plurality of panel strips disposed in parallel vertical relationship, and a plurality of ribbon elements alternately disposed in staggered relationship on either side of each said panel strip to connect said panel strips together and form said shade member, said ribbon elements being affixed at their ends to said shade bars.

15. The construction defined in claim 1, wherein said shade or screen member comprises a unitary flexible sheet of material, a roller, means mounting said roller for rotation upon one said shade bar, the proximal end of said sheet material being affixed to said roller, the distal end of said sheet material being affixed to the other said shade bar.

16. The construction defined in claim 15, wherein said roller is spring loaded biasing said roller attached sheet material toward a rolled up state on said roller.

17. The construction defined in claim 1 or 2, wherein said parallelogram cord system comprises cord portions simultaneously engaging and passing around and over a quadrant of one roller and around and under a quadrant of the adjacent roller at each end of each said shade bars, securing said shade bars in adjustably movable relationship.

18. The construction defined in claim 17, wherein said cord system comprises a single unitary cord fixed at its proximal end to or adjacent the lower end of and at one side of said supporting structure or of one said guide member, and at it distal end to or adjacent the lower end of and at the other side of said supporting structure or of the other said guide member.

19. The construction defined in claim 18, wherein said cord is fixed at a point on said supporting structure adjacent or intermediate the ends of said upper shade bar, or alternatively at or intermediate the upper ends of each said guide members.

20. The construction defined in claim, 17, wherein said cord system includes means to maintain said cord portions in relatively taut relationship to said shade bars.

* * * * *